United States Patent [19]

Baron et al.

[11] 4,140,888

[45] Feb. 20, 1979

[54] DUAL-FEED MICROWAVE OVEN

[75] Inventors: David A. Baron, Edina; Charles R. Buffler, Excelsior; Eldon J. Klemp, Mayer, all of Minn.

[73] Assignee: Litton Systems, Inc., Beverly Hills, Calif.

[21] Appl. No.: 746,405

[22] Filed: Dec. 1, 1976

[51] Int. Cl.[2] ..... H05B 9/06

[52] U.S. Cl. ..... 219/10.55 F; 219/10.55 R

[58] Field of Search ..... 219/10.55 R, 10.55 A, 219/10.55 F

[56] References Cited

U.S. PATENT DOCUMENTS

| | | | |
|---|---|---|---|
| 2,716,694 | 8/1955 | Schroeder | 219/10.55 R |
| 2,748,239 | 5/1956 | Long et al. | 219/10.55 F |
| 2,790,054 | 4/1957 | Haagensen | 219/10.55 F |
| 2,813,185 | 11/1957 | Smith | 219/10.55 F |
| 2,909,635 | 10/1959 | Haagensen | 219/10.55 F |
| 2,993,973 | 7/1961 | Johnson et al. | 219/10.55 R |
| 3,210,511 | 10/1965 | Smith | 219/10.55 F |
| 3,276,138 | 10/1966 | Fritz | 219/10.55 R |
| 3,492,454 | 1/1970 | Smith | 219/10.55 F |
| 3,745,291 | 7/1973 | Peterson et al. | 219/10.55 R |
| 3,975,606 | 8/1976 | Tanaka et al. | 219/10.55 F |

FOREIGN PATENT DOCUMENTS

| | | | |
|---|---|---|---|
| 490295 | 2/1953 | Canada | 219/10.55 F |
| 1134779 | 8/1962 | Fed. Rep. of Germany | 219/10.55 F |
| 1149473 | 5/1963 | Fed. Rep. of Germany | 219/10.55 F |
| 1515070 | 6/1969 | Fed. Rep. of Germany | 219/10.55 |

*Primary Examiner*—Arthur T. Grimley
*Assistant Examiner*—Bernard Roskoski
*Attorney, Agent, or Firm*—Robert E. Lowe

[57] ABSTRACT

A microwave oven including a window portion in each of two opposing side walls through which microwave energy is fed into the oven cavity. The window portions are covered by a microwave transparent panel which is configured to support a shelf within the oven cavity.

5 Claims, 3 Drawing Figures

FIG. 1
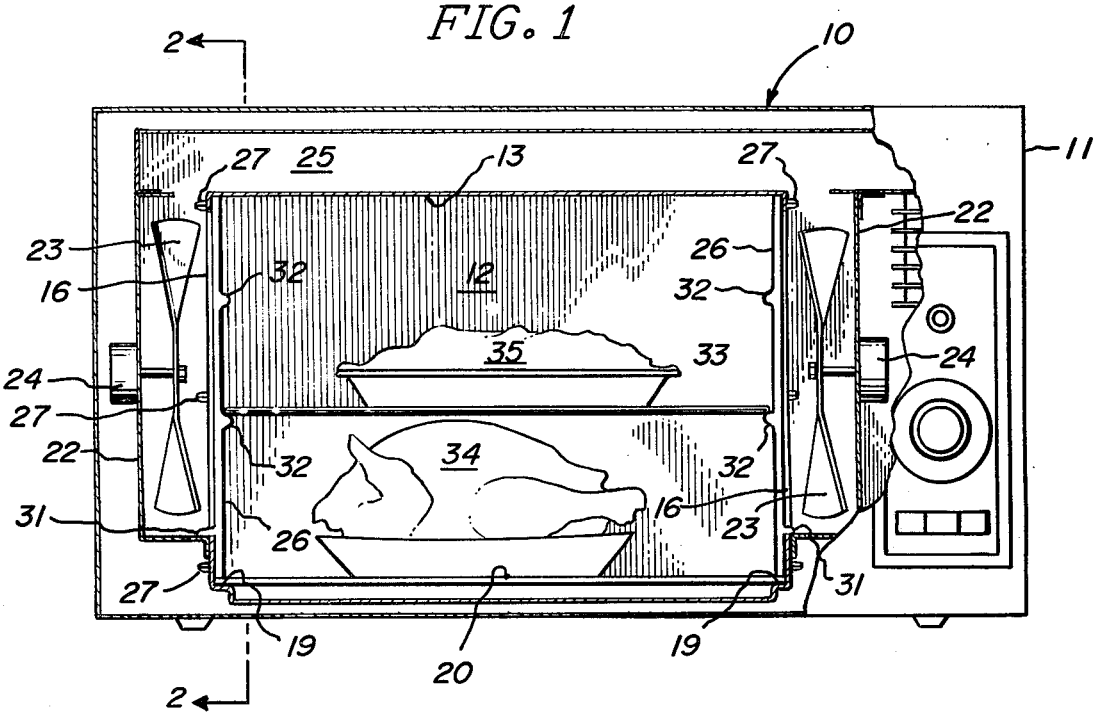
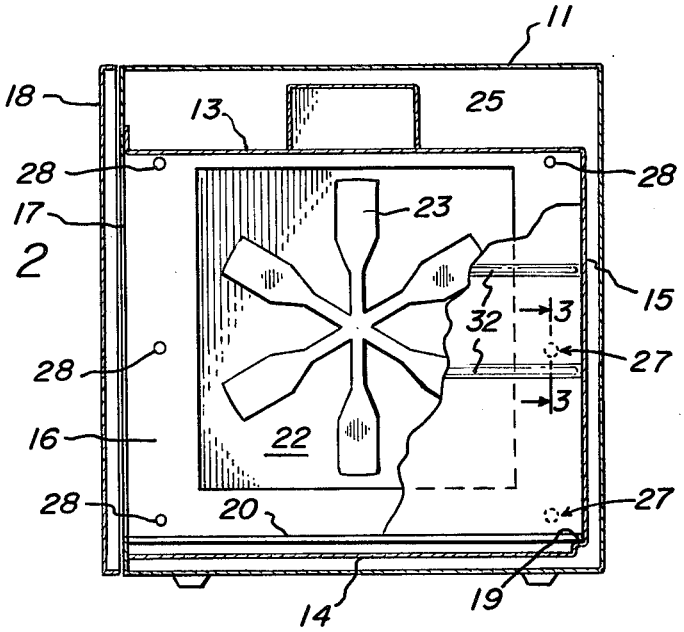
FIG. 2
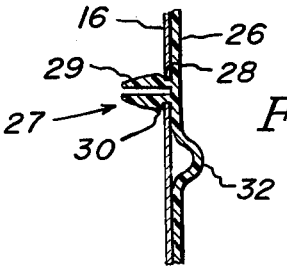
FIG. 3

DUAL-FEED MICROWAVE OVEN

BACKGROUND OF THE INVENTION

This invention relates to improvements in microwave ovens for cooking purposes.

The use of microwave energy to accomplish cooking in domestic and commercial appliances is well-known. Such appliances typically include a generally box-like metal oven cavity including a platform or shelf in the bottom portion upon which food to be cooked is placed. The shelf is normally made of glass, ceramic or other similar microwave transparent material. Microwave energy is generally fed into the cavity by means of an antenna, waveguide or feed box located in the top or bottom wall of the cavity.

Inasmuch as microwave energy tends to establish standing wave patterns within the cavity space, there is a resultant disparity in energy field strengths from one spot in the oven to another and hence a disparity in evenness of cooking.

Moreover, prior designs of microwave ovens have not generally facilitated cooking of more than one type of food simultaneously in a single cavity, but rather have been largely limited to cooking either a single food item such as a roast or casserole, or a number of units of the same food item, such as a number of potatoes. It has not heretofore been considered practical to simultaneously cook two or more dissimilar food items in a microwave oven.

The microwave oven of the present invention is adapted to overcome many of the aforementioned limitations of prior art ovens. The design provides a more even energy distribution within the cavity and thereby provides for more even cooking. Additionally, the design provides a microwave oven that is especially suited to cooking more than one food item of dissimilar types simultaneously. These and other advantages of the new design become apparent as the specification proceeds.

SUMMARY OF THE INVENTION

We have discovered that the performance and usefulness of a microwave oven can be greatly enhanced by our design in which microwave energy is fed into an oven cavity from each side wall rather than from either the top, as is conventional, or from the bottom as is sometimes done. To accomplish the result, windows are formed in each of the opposing side walls of the cavity and an energy feedbox is mounted to the exterior surface of each of said walls communicating with the oven interior by means of the aforesaid windows. The window portions of the side walls, and preferably the entire side wall is covered by microwave transparent panel which serves several functions. In addition to covering the feedbox opening, these panels also provide support surfaces for one or more shelves which can be added to the oven, as well as electrical insulation between the metal oven side wall and the rack in the event that the rack is also made from a conductive metal.

BRIEF DESCRIPTION OF THE DRAWINGS

FIG. 1 is a front view of elevation partially cut-away of a microwave oven incorporating the new design of the present invention; and, FIG. 2 is a cross-sectioned view taken along line 2—2 in FIG. 1; and, FIG. 3 is an expanded scale cross-sectioned view of a portion of the oven wall and liner of the present invention and taken along line 3—3 in FIG. 2.

DESCRIPTION OF PREFERRED EMBODIMENTS

A microwave oven 10 is depicted in the drawings, the oven including an outer cabinet or wrap 11 and an oven cavity 12. The oven cavity 12 is basically a rectangular parallelepiped which includes a top wall 13, a bottom wall 14, a back wall 15, two opposing side walls 16, and a front portion 17 which is largely open and is adapted to be closed by a door 18. A step 19 is formed at the intersection of the side walls 16 and the bottom wall 14 which is used to support a bottom platform or shelf 20. When viewed through the door 18, the shelf 20 appears to be the oven bottom when in fact it is a false bottom with the true bottom of the metal cavity 14 being located below and spaced from shelf 20. The shelf 20 is made from a durable material that is substantially transparent to microwave energy such as tempered glass, ceramic, and the like.

A cut-away window 21 is formed in each of the side walls 16, the windows 21 being large relative to the total area of the side walls. A feed box 22 is mounted to the exterior surface of each of side walls 16 positioned so as to be essentially congruent to the windows 21. An energy stirrer 23 in the form of a bladed fan-like device may be mounted within each of the feed boxes 22 to aid in breaking up undesirable standing wave patterns and contributing to a more evenly distributed energy pattern within the oven cavity 12. The stirrer 23 may be driven by a small motor 24 or by other conventional techniques known in the art.

Each of the feed boxes 22 are in energy transmitting communication with a waveguide 25 such as by physical coupling as shown. However, it will be understood by those skilled in the art that microwave energy can be transmitted to a feed box in a variety of ways which are conventional and such methods are intended to be within the purview of the disclosure.

A smooth, pleasant appearing continuity of the interior walls of oven cavity 12 is accomplished with the addition of side wall panels 26. The panels are made from a material that is substantially transparent to microwave energy in order to allow unimpeded transmission from the feed box 22 to the oven cavity 12 through the windows 21. Many materials can be used for the panels 26 including glass or ceramic materials and various plastics. It is preferred that the panels by polypropylene which exhibits desirable characteristics of formability and microwave transmissability.

The panels 26 should of course extend at least over the windows 21 for esthetic and safety of operation reasons, but it is preferred that the panels extend over the entire interior surface of side walls 16 thus giving the oven interior a smooth, continuous appearance.

The panels 26 can be attached to the side wall using a variety of insulated or dielectric fasteners. Preferably, the panels include integrally molded fasteners 27 which are positioned around the periphery of the panels positioned to mate with holes 28 in side walls 16. Each fastener includes two spaced apart projections 29 having a shoulder 30. The projections 29 move closer together as the fastener passes through one of the holes 28 until the shoulder 30 clears the hole, at which time the resiliency of the material allows the projections 29 to move slightly apart, locking the shoulder 30 against the exterior surface of side wall 16.

Preferably, ridges 31 and 32 are also molded into panel 26. Ridge 31 is molded into the same side as fasteners 27 and is positioned to bear upon the bottom surface of feed box 22 when panel 26 is in position. Ridges 32 are molded into the opposite side of the panel and are used to support an oven rack 33. Ridge 31 aids in supporting the weight of food items placed on the rack 33 and relieves some of the stress from fasteners 27.

The oven rack 33 may be of a design similar to oven racks commonly used in conventional ranges although somewhat smaller and lighter. The rack may be made from a dielectric, microwave non-absorbent material, or it can be made of a microwave reflective material such as metal. A preferred material is chrome plated steel.

We have discovered that a significantly improved energy distribution pattern, and hence cooking pattern, can be obtained with the side mounted feed boxes shown rather than with conventional techniques of feeding microwave energy from only the top or bottom walls. Moreover, since microwave energy is fed into the cavity from each side, the food in the oven does not "block" the energy as occurs in prior art ovens. Because of the improved performance and energy feeding thus obtained, the present design is well suited to cooking more than one food type or unit simultaneously.

Simultaneous cooking of different foods is illustrated in the drawings wherein a first food item 34 is shown resting on the lower platform or shelf 20 while a second food item 35 is supported on rack 33. Each can be cooked satisfactorily at the same time in the oven of the present design whereas prior art ovens would result in most of the energy being absorbed by one item or the other, leaving one substantially uncooked.

In the present design, the side panels 26 not only serve to cover the windows 21 but also serve to support rack 33 and insulate the rack from the metal side walls 16. Arcing between the rack and side walls is thus avoided.

While in the foregoing specification the invention has been described in considerable detail, it will be understood the many modifications can be made by those skilled in the art without departing from the scope or spirit of the invention.

We claim:

1. A microwave oven adapted to cook two or more dissimilar foodstuffs simultaneously including an oven cavity; a microwave energy source; a pair of energy mixing chambers including stirrer means for receiving said microwave energy from said source and transmitting said energy to said cavity, each of said chambers communicating with an opposite side wall of said cavity whereby microwave energy is supplied to said cavity through said side walls; and means for dividing said cavity into first and second cooking regions, said dividing means being electrically insulated from said side walls.

2. A microwave oven for cooking two or more dissimilar foods simultaneously comprising in combination:

a microwave energy source;

an oven cavity including top and bottom walls, a back wall, an open front portion, and a pair of opposing side walls each having a cut-away window portion therein;

an energy mixing chamber mounted to the exterior side of each of said side walls in microwave energy transmitting communication with a respective one of said window portions, each of said chambers having energy stirrer means rotatably mounted therein;

waveguide means interconnecting said microwave energy source and each of said energy mixing chambers;

an inner panel substantially transparent to microwave energy mounted to the interior side of each of said side walls, said inner panels substantially covering said window portions;

moveable shelf means supported between said inner panels to form a first cooking region above said shelf for cooking a first food portion and a second cooking region below said shelf for cooking a second, dissimilar food portion.

3. The apparatus of claim 2 wherein inner panels include integrally formed ridge portions for supporting said moveable shelf means.

4. The apparatus of claim 2 wherein said inner panels are attached to said side walls by fastener means that are integrally molded into said panels.

5. The apparatus of claim 2 wherein said inner panels cover substantially all of the interior surface of said side walls.

* * * * *